US012759951B2

(12) United States Patent
Feier et al.

(10) Patent No.: US 12,759,951 B2
(45) Date of Patent: Oct. 13, 2026

(54) ENERGETIC MATERIAL MIXING DEVICE AND PROCESS

(71) Applicant: Government of the United States as represented by the Secretary of the Air Force, Wright-Patterson AFB, OH (US)

(72) Inventors: Ioan Feier, Castle Rock, CO (US); Bennett Whitney, Libertyville, IL (US); Collin Jensen, Wichita, KS (US); Jackson Mitchell, Woodland, CA (US); Neil Thompson, Santaquin, UT (US)

(73) Assignee: United States of America as represented by the Secretary of the Air Force, Wright-Patterson AFB, OH (US)

( * ) Notice: Subject to any disclaimer, the term of this patent is extended or adjusted under 35 U.S.C. 154(b) by 133 days.

(21) Appl. No.: 18/960,861

(22) Filed: Nov. 26, 2024

(65) Prior Publication Data

US 2026/0146010 A1 May 28, 2026

(51) Int. Cl.
*C06B 21/00* (2006.01)
*C06B 25/34* (2006.01)

(52) U.S. Cl.
CPC ..... *C06B 21/0041* (2013.01); *C06B 25/34* (2013.01)

(58) Field of Classification Search
None
See application file for complete search history.

(56) References Cited

U.S. PATENT DOCUMENTS

| | | | | |
|---|---|---|---|---|
| 5,712,445 | A * | 1/1998 | Kassuelke | F42B 5/181 102/288 |
| 6,071,444 | A * | 6/2000 | Worrell, Jr. | C06B 45/00 264/156 |
| 7,118,057 | B2 | 10/2006 | Hao | |
| 7,665,339 | B2 | 2/2010 | Valence | |
| 8,552,084 | B2 | 10/2013 | Tynan, Jr. | |
| 9,328,268 | B2 | 5/2016 | Tynan, Jr. | |
| 10,569,280 | B2 | 2/2020 | Busenhart | |
| 2016/0052836 | A1 * | 2/2016 | Penney | C06B 25/34 149/92 |

(Continued)

FOREIGN PATENT DOCUMENTS

| | | |
|---|---|---|
| EP | 0610028 | 5/2000 |
| EP | 0967025 | 3/2003 |

(Continued)

OTHER PUBLICATIONS

Tillotson et al.; Sol-Gel Processing of Energetic Materials, 5th International Symposium on Aerogels, Montpellier, France, Sep. 8-10, 1997; 14 pages.

*Primary Examiner* — Aileen B Felton
(74) *Attorney, Agent, or Firm* — AFMCLO/JAZ; Charles R. Figer, Jr.; Roddy Bullock

(57) ABSTRACT

A method for producing a compressed composite energetic material. The method includes the step of providing a first compressible material, providing an energetic material, and combining the first compressible material and the energetic material into a composite material. The composite material is supplied to a plurality of pairs of primary compression rollers and compressed into a single web. The single web can be extruded through an extruder in a final mixing step.

20 Claims, 7 Drawing Sheets

(56) References Cited

U.S. PATENT DOCUMENTS

| | | | |
|---|---|---|---|
| 2023/0009511 | A1 | 1/2023 | Hackfort |
| 2023/0052046 | A1 | 2/2023 | Weldige |
| 2023/0085467 | A1 | 3/2023 | Palma |
| 2023/0125402 | A1 | 4/2023 | Cleveland |

FOREIGN PATENT DOCUMENTS

| | | |
|---|---|---|
| EP | 3145687 | 3/2017 |
| JP | 4898435 | 3/2012 |
| KR | 10-2434310 | 8/2022 |

* cited by examiner

ENERGETIC MATERIAL MIXING DEVICE AND PROCESS

TECHNICAL FIELD

The present disclosure relates to mixing of energetic materials.

BACKGROUND

Energetic materials refer to the category of explosives, propellants and pyrotechnics, all important to the performance of weapon systems. Traditional manufacturing of energetic materials involves processing of granular solids. One application is the production of detonators where powders of energetic material and a binder are typically mixed and compacted at high pressure to make pellets.

According to a 2022 article in National Defense, "It isn't enough to simply invent new energetic materials; they also have to be produced safely and reliably at scale. Batch processing is the mainstay of production at U.S. munitions plants today, but more modern manufacturing technologies could be applied to improve production processes." (https://www.nationaldefensemagazine.org/articles/2022/3/30/us-needs-to-refocus-on-energetic-materials)

There is a continuing unmet need for continuous methods, systems and processes for manufacturing energetic materials.

BRIEF DESCRIPTION OF THE DRAWINGS

The following detailed description of embodiments of the present disclosure can be best understood when read in conjunction with the drawings enclosed herewith.

Figure 1:
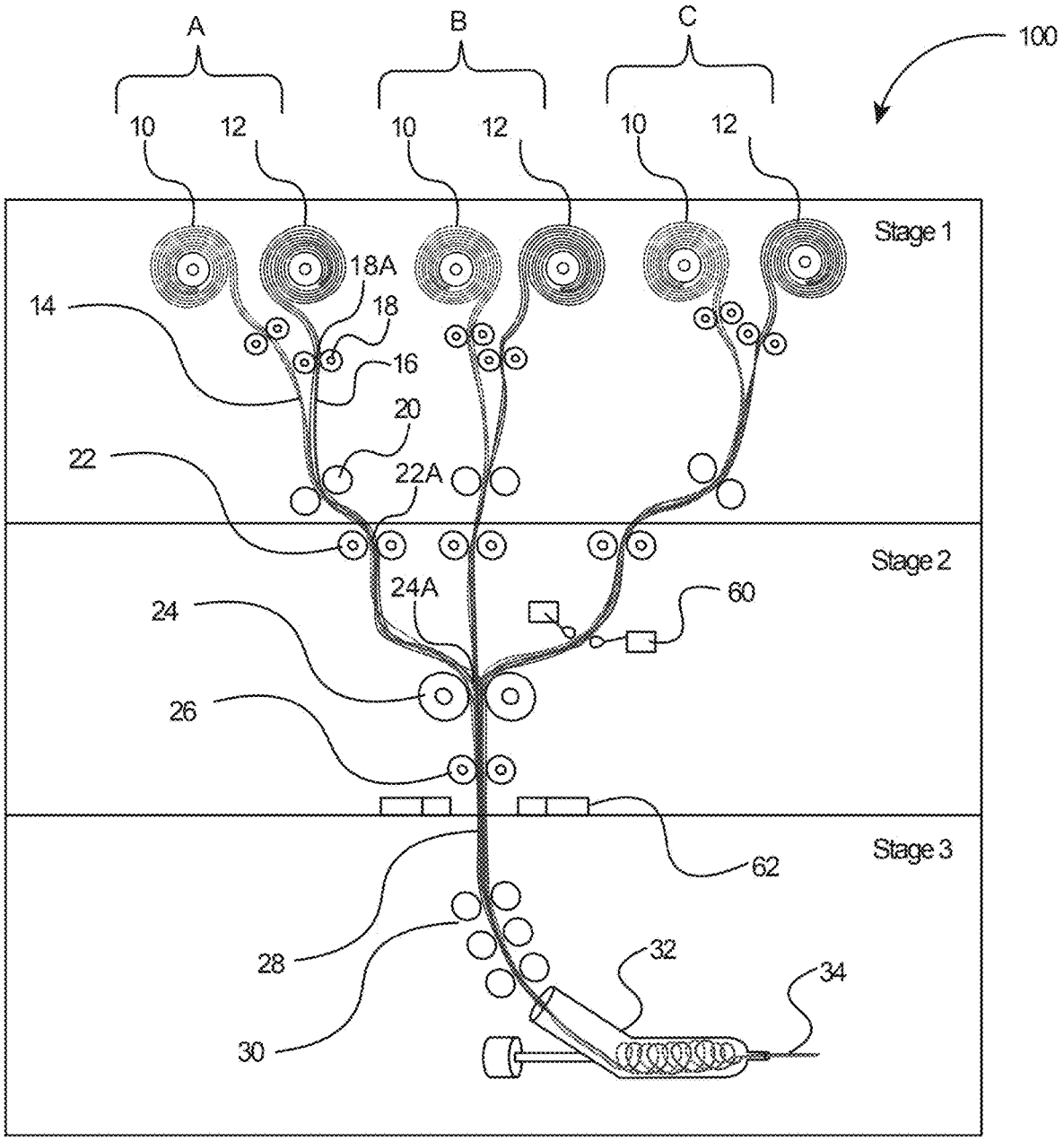
FIG. 1 is a schematic diagram of an example embodiment of a mixing apparatus.

The embodiments set forth in the drawings are illustrative in nature and not intended to be limiting. Moreover, individual features of the drawings and the disclosure will be more fully apparent and understood in view of the detailed description.

DETAILED DESCRIPTION

Various non-limiting embodiments of the present disclosure will now be described to provide an overall understanding of the principles of the structure, function, and use of the apparatuses, systems, methods, and processes disclosed herein. One or more examples of these non-limiting embodiments are illustrated in the accompanying drawings. Those of ordinary skill in the art will understand that systems and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

Reference throughout the specification to "various embodiments," "some embodiments," "one embodiment," "some example embodiments," "one example embodiment," or "an embodiment" means that a particular feature, structure, or characteristic described in connection with any embodiment is included in at least one embodiment. Thus, appearances of the phrases "in various embodiments," "in some embodiments," "in one embodiment," "some example embodiments," "one example embodiment, or "in an embodiment" in places throughout the specification are not necessarily all referring to the same embodiment. Furthermore, the particular features, structures or characteristics may be combined in any suitable manner in one or more embodiments.

The examples discussed herein are examples only and are provided to assist in the explanation of the apparatuses, devices, systems, and methods described herein. None of the features or components shown in the drawings or discussed below should be taken as mandatory for any specific implementation of any of these the apparatuses, devices, systems, or methods unless specifically designated as mandatory. For ease of reading and clarity, certain components, modules, or methods may be described solely in connection with a specific FIG. Any failure to specifically describe a combination or sub-combination of components should not be understood as an indication that any combination or sub-combination is not possible. Also, for any methods described, regardless of whether the method is described in conjunction with a flow diagram, it should be understood that unless otherwise specified or required by context, any explicit or implicit ordering of steps performed in the execution of a method does not imply that those steps must be performed in the order presented but instead may be performed in a different order or in parallel.

The method of the disclosure involves methods and apparatuses in a system to mix energetic materials in a continuous process to make a compressed composite energetic material. The energetic materials can include those known for explosives, such as cyclonite or hexogen, also known as RDX, and/or octogen and cyclotetramethylenetetranitramine, also known as HMX, and/or trinitrotoluene also known as TNT, and/or nitrotriazolone also known as NTO. Energetic materials can be in powdered or granular form and overall explosives are often mixtures of multiple materials to include granular energetics (e.g. RDX/HMX/NTO crystals, metal/oxidizer pairs, etc.), binders, catalysts, other fuel/oxidizer and possibly other materials to improve stability, casting, and temperature performance. In general, energetic materials such as RDX, HMX, or NTO crystals can have mean particle sizes from about 1 micron to about 200 microns.

One of the advantages of the systems and methods of the disclosure is that the integrity of the particles of the energetic material is preserved. As disclosed more fully herein, the spacing of rollers, i.e., the nip, in the apparatuses described can be set such that crushing of the particles of the energetic material is minimized or eliminated. The energetic material is processed in a relatively low mechanical pressure process that uses rollers to mix multiple layers of materials to perform mixing. In this manner, various materials at different proportions can be mixed, and the proportion ratios can be dynamically controlled.

The method involves several stages of continuous processing. In a first stage material is introduced from rolled reels of material. In a second stage mixing occurs in the nip(s) of roller assemblies. Finally, material is collected for ultimate storage or delivery, or further processing into forms for storage and use.

Figure 2:
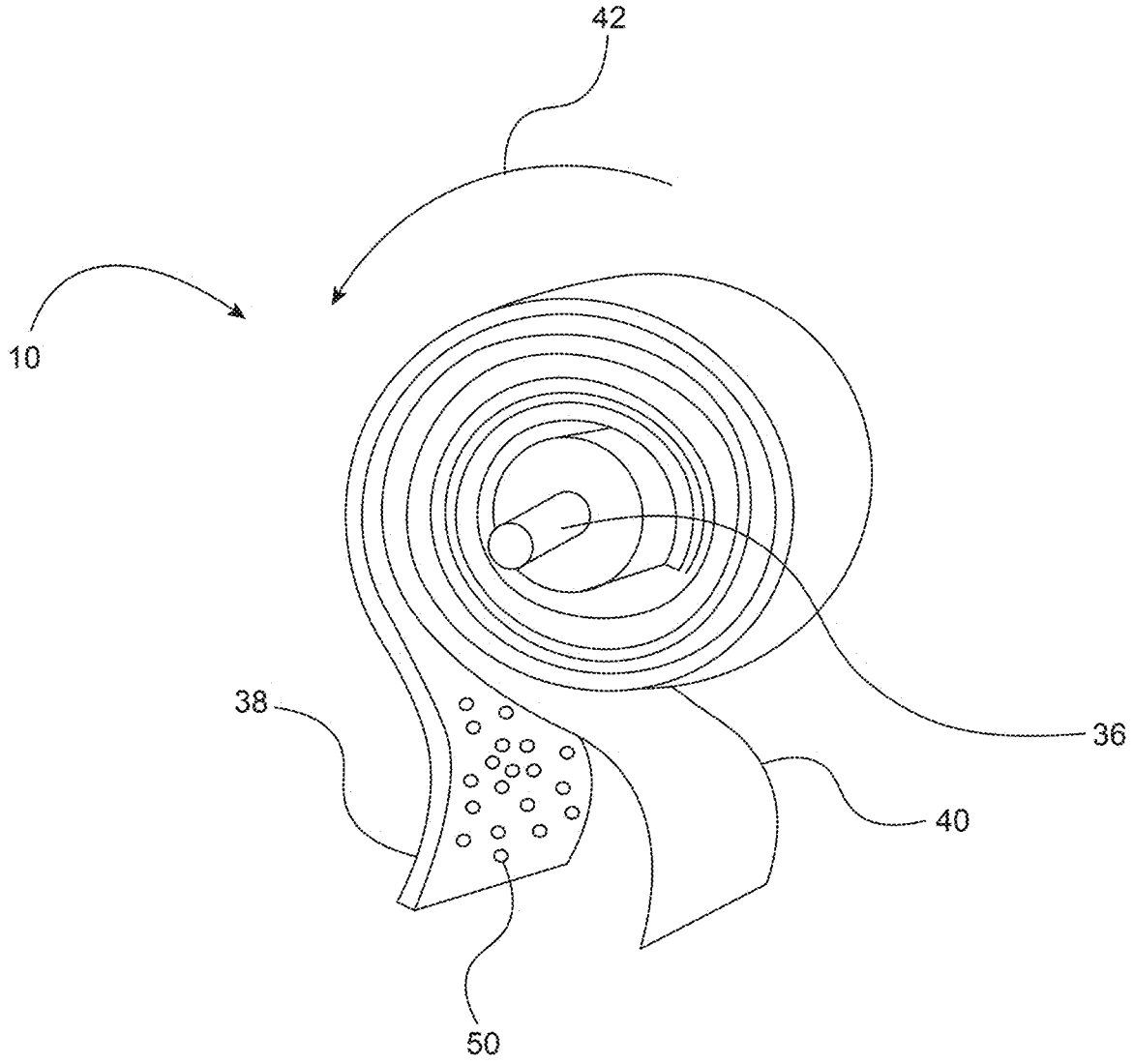
FIG. 2 is perspective view of an example reel of web material.

Referring to FIG. 1, an embodiment of a mixing system 100 is shown. The mixing system 100 can be utilized to combine and mix at least two materials from a web, or tape, and can include more than one pair of compression rollers. While more than two materials can be combined for mixing, in the illustrated embodiment three sets, A, B, and C, of two materials are combined. In an embodiment, the materials have the same composition and can both be compressible materials. In an embodiment, the materials are different, and one can be a relatively more compressible than the other. Using Set A as depicted in FIG. 1 as an example, a first material 10 and a second material 12 can each be supplied from a roll such that they reel off in a facing relationship. An example roll arrangement is depicted in FIG. 2. First material 10 or second material 12 can have applied thereon, embedded therein, or otherwise be supplied with an energetic material 50, as indicated in FIG. 2.

Referring to FIG. 2, there is shown an example embodiment of a rolled material that can be one of the first material 10 or second material 12. The first material 10 is indicated for purposes of illustration, and it can be supplied in a roll format and can be unreeled in the direction of arrow 42 about an axis of rotation defined by axle 36. The first material 10 can include a release paper surface, such as an interface tape 40 that prevents or minimizes sticking of adjacent layers of the rolled material. As the first material 10 is unreeled, the interface tape 40 can be removed and discarded prior to entering the nip of the first compression rollers 22. The first material 10 can include in or on it an energetic material 50.

The first material 10 or the second material 12 can be a compressible material, and can be a carrier material 38 which is an energetic material and/or on which or in which is disposed an energetic material 50 in a homogeneous and/or particulate form. The energetic material 50 can be disposed in a pattern, or generally uniformly on or in the first material 10 (or any of the other materials supplied in the process). In an embodiment, both the first material 10 and the second material 12 (for each set of materials, e.g., set A, B, or C) act as a carrier material for the energetic material 50 in particulate form. In an embodiment, the energetic material 50 is added to one of the first material 10 or second material 12 before, or during the unreeling of the first material 10 or second material 12 before mixing at first compression rollers 22, as shown in FIG. 1. First compression rollers 22 can comprise metal, such as aluminum or stainless steel, and can be mounted in parallel orientation wherein their respective axial axes are parallel.

Referring again to FIG. 1, one or both of the first material 10 and the second material 12 from each set A, B, and C of paired materials can, in an example embodiment, be thinned by a pair of thinning rolls 18. Thinning rolls 18 can be two rollers forming a nip 18A through which the first material 10 and/or the second material 12 pass prior to the mixing rollers downstream in the process. The dimension of nip 18A of thinning rolls 18 can be set manually or by motorized adjustment to a predetermined dimension to achieve desired compression and thinning of the first material and/or the second material 12. In an embodiment, one or both thinning rolls 18 can be mounted on an eccentric shaft for nip 18A adjustment. The thinning rolls 18 can be powered or unpowered and can be made of any durable material suitable for interfacing with the first material 10 and/or the second material 12. In an embodiment, the thinning rolls 18 are made of stainless steel, and are mounted in a parallel, spaced relationship. The thickness of one or both of the first material 10 and/or the second material 12 can be adjusted to control mixing ratios, for example.

Figure 4:
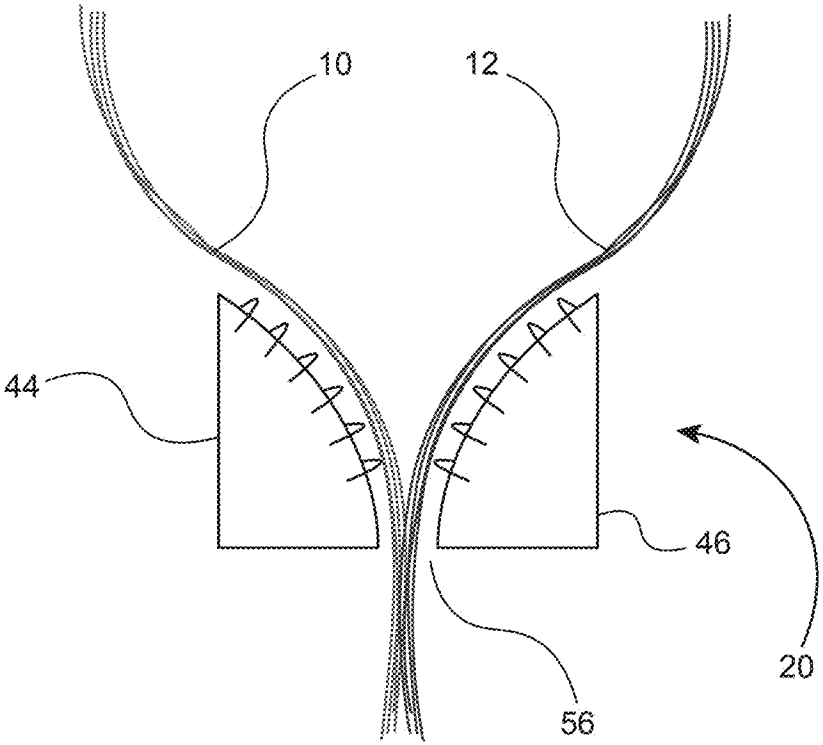
FIG. 4 is a side view of example air bearing surfaces.
Figure 3:
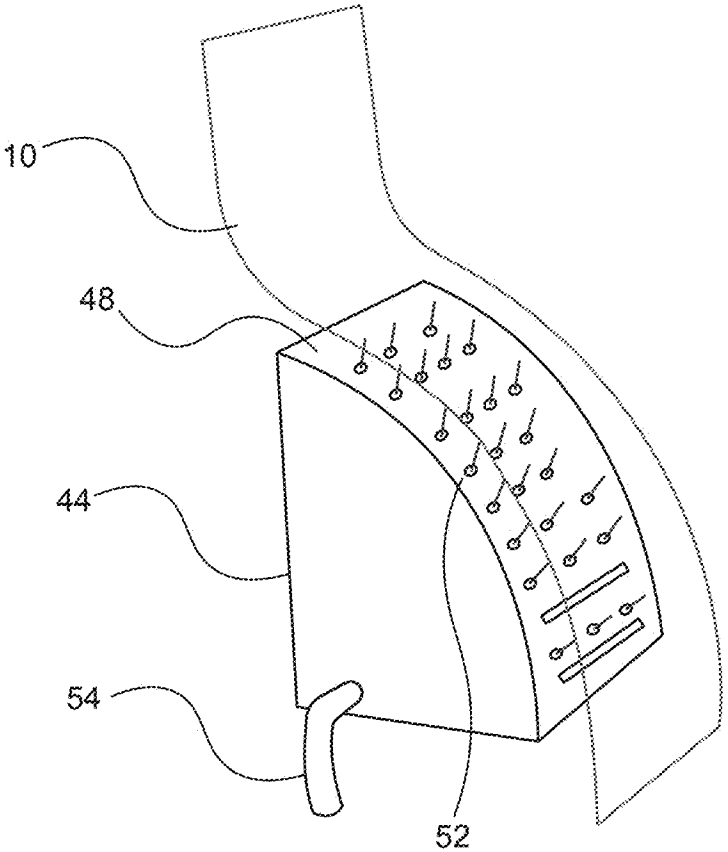
FIG. 3 is a perspective view of an example air bearing surface.

The first material 10 and the second material 12 can optionally be web guided in the path of processing by one or more sets of web guides 20. Web guides 20 can be web guide bars or rollers, such as a smooth bar or roller over which the materials can smoothly pass to change direction of processing. In an embodiment, as depicted in FIG. 1, the web guides 20 can be a pair of opposed rollers having a nip through with the materials can be web guided without compression. Any rollers used for web guides can be optionally powered or unpowered. Other options for web guides 20 include web guide vanes, slots, ducts, or other guiding assemblies. By way of example, FIGS. 3 and 4 depict a web guide 20 in the form of opposed air bearing surfaces. An air bearing web guide 20 As shown in perspective view in FIG. 3, a first air bearing member 44 includes an air supply 54 through which air is forced into the first air bearing member 44. The forced air can exit the first air bearing member 44 through a plurality of openings 52. The exiting air forms an air bearing surface on the first air bearing member 44 to provide a web guide surface for first material 10. As indicated schematically in the side view of FIG. 4, a second air bearing member 46 can be suitably positioned opposite the first air bearing member 44 to provide a nip 56 through which the first material 10 and second material 12 can pass.

Referring again to FIG. 1, for each pair of materials to be mixed, the first material 10 and the second material 12 enter the nip of paired mixing rollers, such as first mixing nip 22A of first compression rollers 22. First compression rollers 22 are positioned relative to one another such that the first mixing nip 22A through which the first material 10 and the second material 12 pass is sufficient to compress and mix the first material 10 and the second material 12. The first mixing nip 22A dimension can be set manually or by automated, powered adjustment such that crushing of the granular or powdered energetic material 50 is minimized or avoided altogether. In an embodiment, one or both first compression rollers 22 can be mounted on an eccentric shaft that can be rotated for first mixing nip 22A adjustment. One or both of the first compression rollers 22 can be powered to act as a driving force to unreel the first material 10 and the second material 12, and each can be made of any durable material suitable for interfacing the materials for the purposes of the disclosure. In an embodiment the first compression rollers 22 can be made of stainless steel.

Once the first material 10 and the second material 12 from set A and any other set, such as sets B and C, pass through the first compression rollers 22, the sets of mixed materials can be further mixed as depicted in the example embodiment of FIG. 1. As depicted, secondary compression rollers can be second mixing rollers 24 and can be positioned to receive through a second mixing nip 24A a plurality of pairs of materials. In an embodiment, additional mixing rollers, such as third mixing rollers 26 can further compress and mix the pairs of materials. The sets of mixing rollers, e.g., first compression rollers 22, second mixing rollers 24, and optionally, additional mixing rollers such as third mixing rollers 26 can be powered in a controlled manner suitable for the materials being mixed. The controls for web control can be suitably set to avoid undesired stretching, thinning, breaking, bunching, or uncontrolled distortion of the materials.

The compression of the materials in the second mixing nip 24A of second mixing rollers 24 can be sufficient to impart mixing of the materials. Mixing occurs as the compressive forces of the second mixing rollers 24 press the materials together sufficient to mix materials. In an embodiment, one or both of the second mixing rollers 24 can be mounted on an eccentric shaft that can be rotated for nip 18A adjustment. The second mixing nip 24A dimension can be set manually or by automated, powered adjustment such that crushing of the granular or powered energetic material 50 is minimized or avoided altogether.

After exiting the mixing rollers, or the plurality of mixing rollers, the compressed, mixed, web of materials 28 can be further processed for collection, storage, or distribution. As depicted in FIG. 1, in an example embodiment, web guide members 30, such as chutes, ducts, rollers, or the like can direct the mixed material web 28 for processing into a form more suitable for storage or use. In an example embodiment, an extruder 32, such as a screw extruder, can further mix and shape the mixed material web 28 into an extrudate 34. The extrudate 34 can have a cross-sectional shape determined by extrusion dies, such as circular, rectangular, or other polygonal shape. The extrudate 34 can be cut to length for storage or use.

Figure 5:
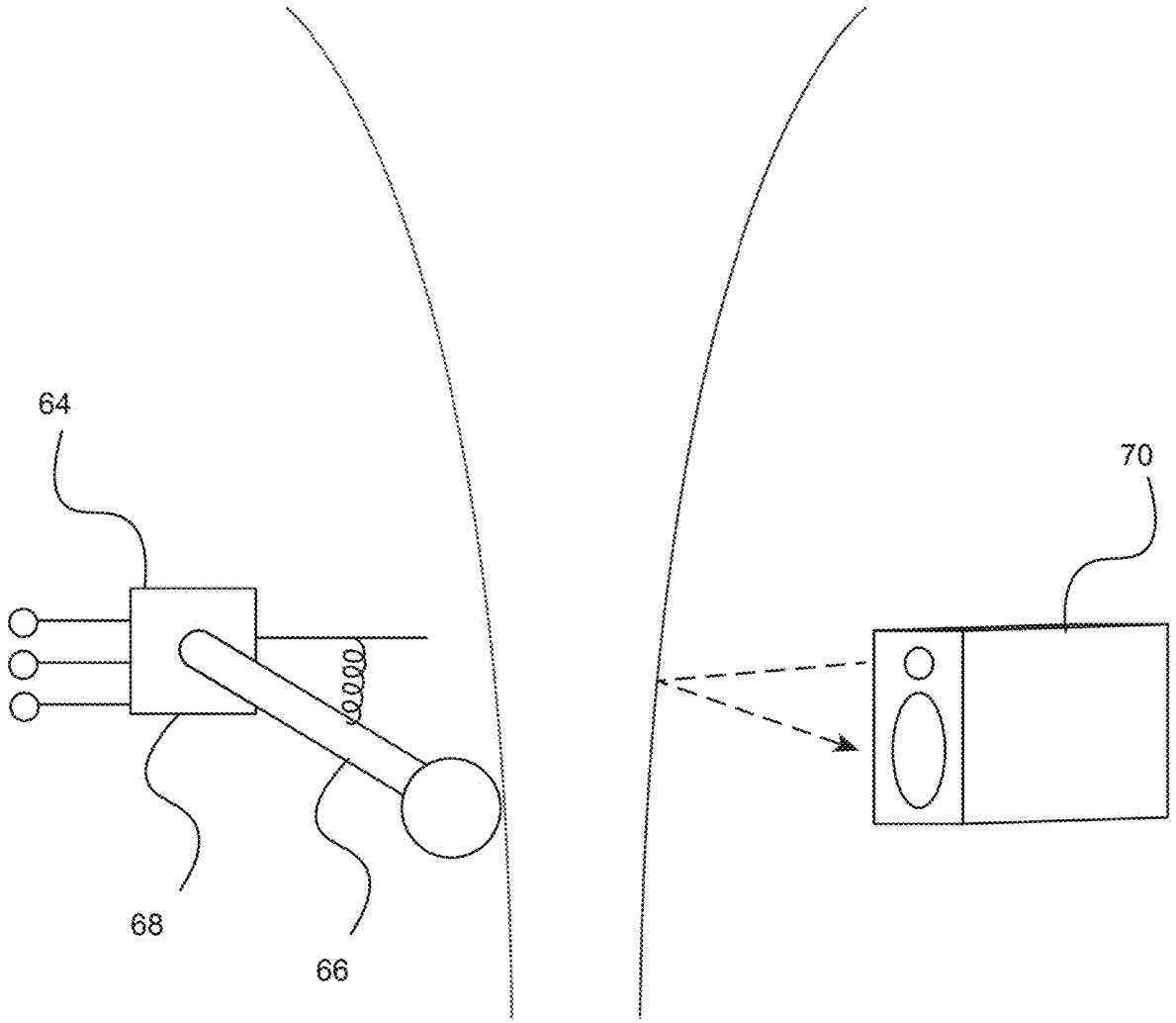
FIG. 5 is a schematic representation of tension control members.

Referring to FIG. 1, various optional processing apparatuses and assemblies can be utilized in the method and system of the disclosure. For example, tensioning sensors 60 can be employed where desired or necessary to ensure proper tension of the material webs as they are processed. Tensioning sensors can utilize mechanical members, such as lever arms, contact members, and the like. For example, as depicted in FIG. 5, in an embodiment, the tensioning sensor 60 can be a contact sensor 64 utilizing a spring-loaded tensioning arm 66 electronically connected to potentiometer 68 for tension detection and adjustment. Tensioning sensors can also be non-contact, utilizing vision systems, electronic detection, proximity detection, and the like. For example, as depicted in FIG. 5, in an embodiment, the tensioning sensor 60 can be a non-contact sensor 70 utilizing, for example, laser or lidar distance sensing.

Figure 6:
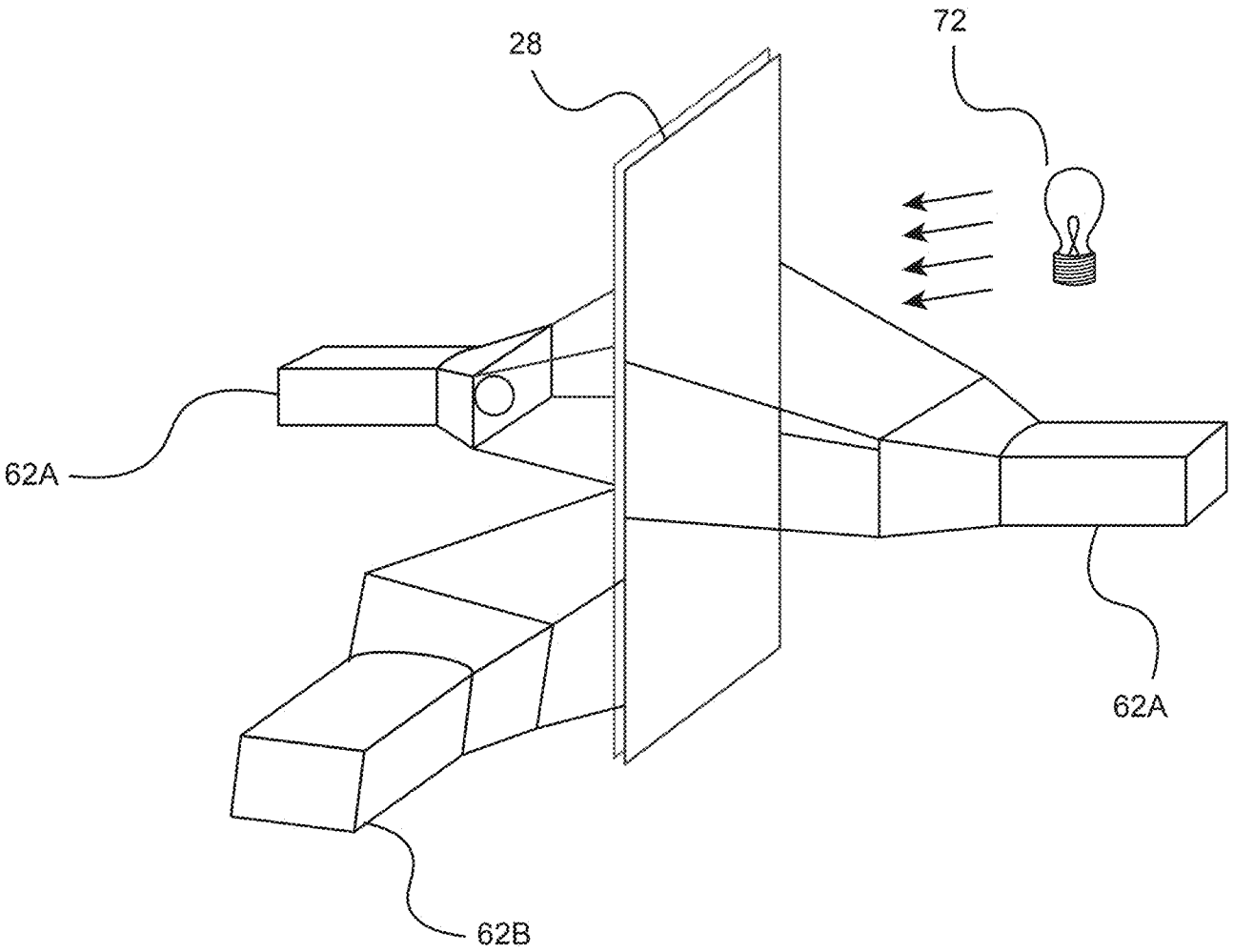
FIG. 6 is a perspective depiction of example camera configurations.

The processing apparatus can also include vision sensors, such as cameras 62 in FIG. 1, can be suitably located to detect web control, mixture detection, inspection, and evaluation. As shown in FIG. 6, vision sensors can be utilized in any configuration desired to detect various properties of the material being processed, such as materials 28, discussed above with reference to FIG. 1. One or more surface cameras 62A can be positioned for visual inspection, detection, and adjustment of the faces of the material 28 being processed. Additionally, or alternatively, one or more edge cameras 62B can be positioned for visual inspection, detection, and adjustment of the edges of the material 28. The cameras may be optical, infrared, or other wavelengths. Additionally, either reflected or transmitted light (or electromagnetic energy) can be detected. X-ray cameras/detectors can also be utilized. If desired, lighting 72 can be supplied to improve the operation of vision sensors.

Figure 7:
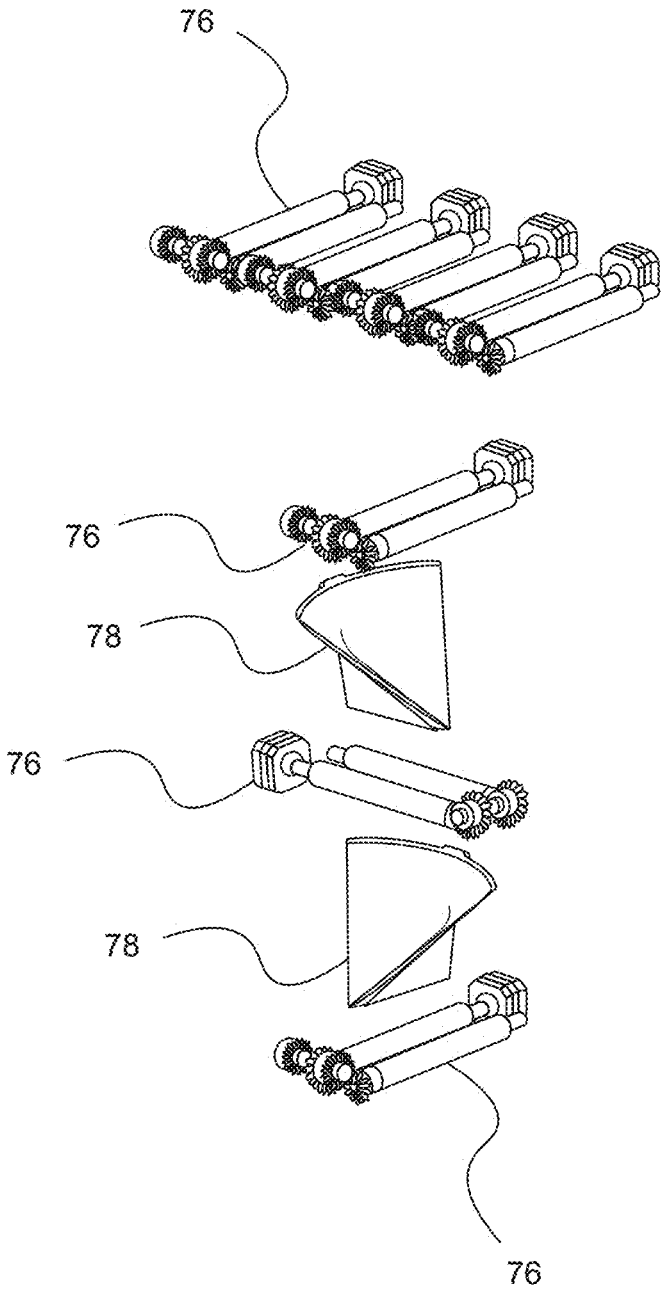
FIG. 7 is a perspective depiction of example folding apparatuses.

Other optional processing apparatuses can include folding members that can fold a web of material onto itself for additional compression and mixing. As depicted in FIG. 7, folding lengthwise can be achieved by mechanical contact via web guide surfaces 78, or by noncontact folding, such as by air pressure (not shown). Web guide rollers 76 can be mounted in alternatingly orthogonal directions to accommodate the folding configuration imparted by the web guide surfaces 78. The web guide rollers 76 can be driven, such as by stepper motors.

Referring now to FIGS. 8-11, there is shown an alternative embodiment of a mixing system 200 involving three subsystems: a material supply subsystem 220, a mixing subsystem 240, and an extrusion subsystem 260.

The material supply subsystem includes two material supply chutes 202, each having a tubular material holder 204 that opens at a rectangular material release opening 206 into the nip 242 of a pair of primary compression rollers 244 in the mixing subsystem 240. In an embodiment, the mixing subsystem 240 can include a plurality of primary compression rollers 244 into which corresponding pairs of material supply chutes 202 deposit material to be mixed. In the embodiment illustrated in FIG. 10, there are four pairs of primary compression rollers 244.

The tubular material holder 204 can be made of metal, including, e.g., aluminum or stainless steel. Each tubular material holder 204 can have a volume of between about one-tenth liter and 2 liters. In an embodiment, each tubular material holder 204 can have a volume of about one liter. A piston (not shown) can be operatively positioned and actuated inside to push material into and through the material release opening 206. In general, a pair of tubular material holders 204 can be utilized to allow for predetermined mixture ratios by changing the material composition inside the tubular material holders 204 and/or adjusting the rectangular openings 206 via a moveable gate 208 controlled by rack and pinion gearing 210. The rack and pinion gearing can be controlled by motorized means, such as servo motors (not shown). The rectangular material release opening 206 can have a largest side dimension of between about 5 cm to about 20 cm and can be about 15 cm.

Figures 8, 9, 10, 11:
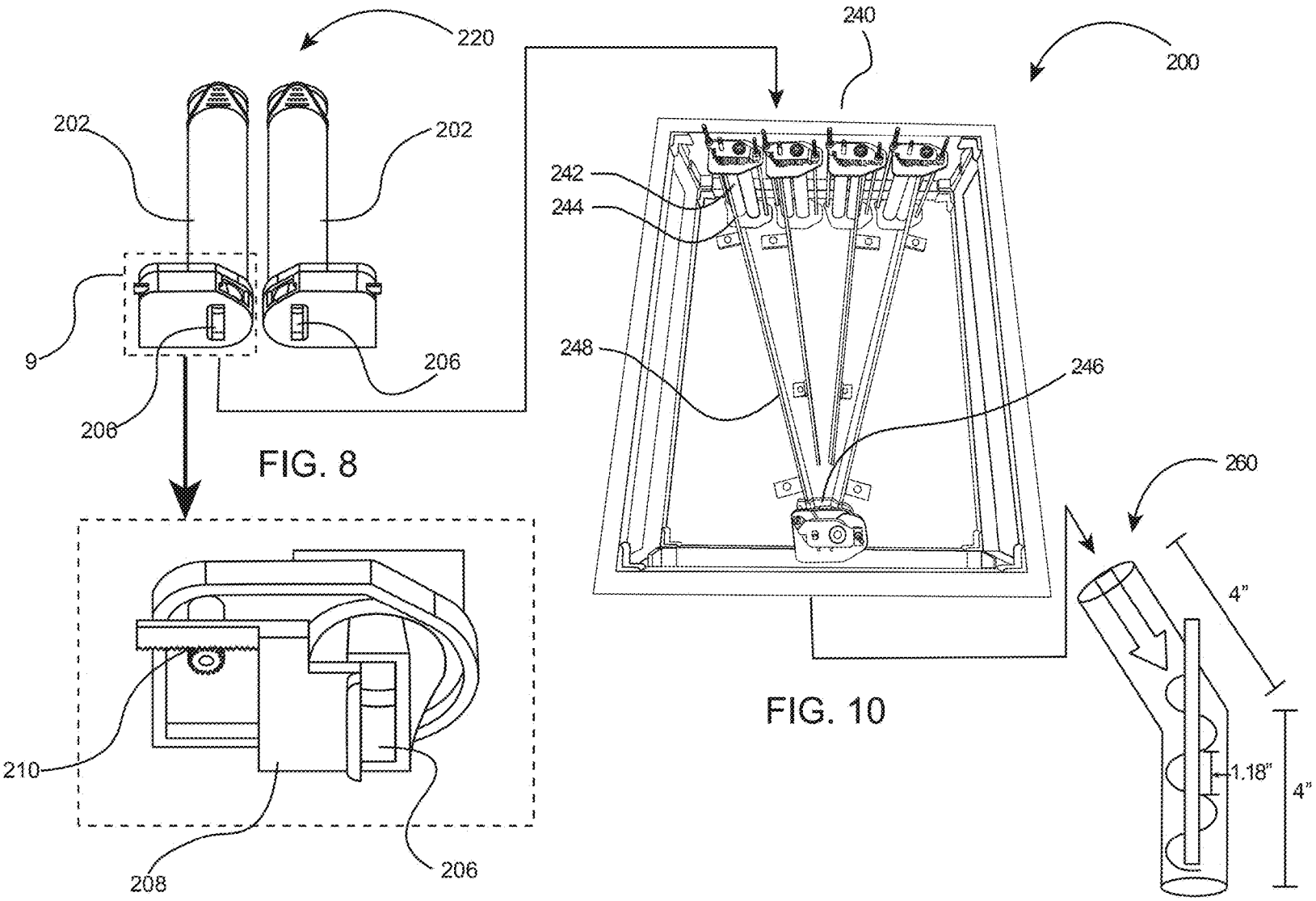
FIG. 8 is a perspective view of a material supply subsystem.
FIG. 9 is a perspective magnified view of inset 9 of FIG. 8.
FIG. 10 is a perspective view of a mixing subsystem.
FIG. 11 is a schematic representation of an extrusion subsystem.

The mixing subsystem 240 can include multiple pairs of primary compression rollers 244; four pairs are shown in FIG. 10. Each pair of primary compression rollers 244 can be supplied with material from two tubular material holders 204, for a total of eight tubular material holders 204. As the material leaves the tubular material holders 204, it goes through the nip 242 of each pair of primary compression rollers 244 to be deformed into a generally flat web of material that can be further drawn down by entering the nip of the secondary compression rollers 246 to achieve additional mixing of material from each of the primary compression rollers 244.

Each pair of primary compression rollers 244 and the pair of secondary compression rollers 246 serve to compress the material deposited from the tubular material holders 204, which can include energetic material mixed with a first or second alternative material, as described above. As disclosed above, the spacing of rollers, i.e., the nip, in the pairs of compression rollers in the mixing subsystem 240 described can be set such that crushing of the particles of the energetic material is minimized or eliminated. In the mixing system 200 the energetic material can be processed in a relatively low mechanical pressure process that uses rollers to mix multiple layers of materials to perform mixing. In this manner, various materials at different proportions can be mixed, and the proportion ratios can be dynamically controlled.

The pairs of primary compression rollers 244 and the pair of secondary rollers 246 can be driven, powered by servo motors. In an embodiment, the pair of secondary compression rollers 246 can be driven at a rotational velocity n times the rotational velocity of the pairs of primary compression rollers 244, where n equals the number of pairs of primary compression rollers 244. In the illustrated embodiment, the pair of secondary rollers 246 are driven at a rotational velocity four times the rotational velocity of the pairs of primary compression rollers 244. As the material is processed as a flattened web through the pairs of primary compression rollers 244, the material can be flattened into a web of about 1.5 mm in thickness. As the webs leaving the pairs of primary rollers are driven to the pair of secondary compression rollers 246, they can be supported and/or web guided by web guide members 248, such as acrylic web guides having surface properties that minimize or eliminate any interference with the movement of the web material toward the secondary compression rollers, except for guiding. Further, web guides can include features to avoid static buildup (e.g. conductive transparent plastics or glass if visibility is needed, or metallic conductive materials otherwise.)

At the secondary pair of compression rollers 246, the multiple (e.g., four, in the embodiment shown in FIG. 10) webs of material are combined in the nip of the pair of secondary compression rollers 246, and compressed to a thickness of about 1.5 mm. The compressed, mixed material leaves the nip of the pair of secondary compression rollers and goes to the extrusion subsystem 260.

The extrusion subsystem 260 can include an auger-style extruder that can be positioned at a 45-degree angle downwards relative to the mixing subsystem 240. The auger-style extruder compresses the material through a static mixing element. This static mixing element provides for a final mixing step, to ensure that the material is homogenously mixed. The material is then compressed down a nozzle (not shown) before the material exits the system. The nozzle design allows for multiple orifice diameters, ranging from 1 millimeter to 10 millimeters. The nozzles can be threaded, thus changing the nozzle diameter is done by unscrewing the current nozzle and screwing on the next desired nozzle.

It is important to note that the largest source of material waste is during this step. The static mixing element does not allow for the auger to pass through, thus any material past the static mixing element will be reliant on material pushing it to the final extrusion. Therefore, the distance of the nozzle is minimized to 25 millimeters in length for all of the different nozzle sizes. If the volume of material is exact, and the amount of wasted material cannot be added introduced into the system, a more abundant simulant material may be added to the material introduction. This simulant material will provide additional pressure past the static mixing element to fully extrude out the material trapped within the nozzle.

Any motors of the method, system, and apparatuses can be stepper motors, servo motors, and can be controlled electronically via microprocessor I/O boards, for example. Other rotary power devices could also be used including pneumatic or hydraulic motors. In addition to direct drive, a geared or belted arrangement could be used to drive rollers, and one direct or indirect motorized connection could power multiple roller pairs. Digital microcontrollers can be utilized for controls, as well as PLC, industrial controllers, mechanical computers, fluidic computers, analog computers and the like. Speed control of individual rollers can be achieved using PID (proportional integral derivative) control algorithms.

Any rollers of the method, system, and apparatuses can be perforated and internally pressurized to promote the separation of contacting materials at the exit of the nip. Pressurization may be uniform through the periphery of the rollers. Conversely, the rollers can be subjected to a partial pressure, e.g., a vacuum, to aid in securing the material into the nip. The gap of the nip between roller pairs can be adjusted by placing one of the rollers on an eccentric that can be rotated to adjust the gap of the nip. Other methods to adjust the roller separation include supplying rollers having screw drives on one of the axles that can adjust separation. Alternatively, the rollers could be elastic, such that an internal pneumatic or hydraulic force can expand one (or both) of the roller diameters, thus varying the nip gap between the rollers. The rollers could be heated or cooled to help modify the material viscosity as it passes through the nip, or to promote/inhibit chemical reactions due to temperature considerations. For example, materials that are liquid at room temperature may be cooled to increase their viscosity for better processing through the nip of rollers. Other alternative embodiments of rollers include rollers could be textured with various patterns, rollers need not be of same diameter, and roller pairs could be tapered (e.g. two cones with both points in the same or opposite directions).

Further alternative processing apparatus include providing materials in a form other than as a web. Materials supplied in bulk, non-web, form can be preprocessed via shape-inducing methods to form the materials into webs for processing as described herein. In general for any materials or methods utilized, irregular edges of material can be cut away using rotating knives/discs, air knifes, or instead rolled to be smooth. Likewise, external air pressure or jets (e.g. air jet knifes, Coanda jets) can be used to tension the material webs and act as non-contact web guides.

In addition to the non-limiting examples discussed above, other alternative processing and method steps are contemplated. Various metals could be beneficial for construction, especially the web guides, in order to avoid static buildup. Antistatic plastics could also be used in apparatus construction, as well as conductive composites (carbon fiber etc.) Solid sheets can be incorporated and intermixed with the material to be mixed. For example, a solid thin sheet of metal or plastic as a carrier sheet could be used at the center of the mixer, allowing material buildup on both sides. This carrier sheet could be used to provide rigidity and support for the final mixed material coming out of the final mixing rollers. Alternatively, a thin solid laminating sheet on either side of the material exiting the mixing rollers can result in the output tape being encapsulated on either side with protective film or layer. To aid in web handling, powdered or particulate materials could be incorporated between web materials. Different powders/particulates could be used in between different layers and the amount of mixing within the bulk can be controlled by controlling the roller gaps. Alternatively, either side of the web as they go through the roller mixer could be sprayed with a fluid to coat either side. Fluid could be sprayed, wiped, brushed, or applied in a laminar flow fashion to coat any of the material webs at any point in the process.

The described process and apparatus is applicable to materials processing and mixing of materials. While described in the context of energetic materials suspended in materials in the form of crushing solid grains, the apparatus and process can be used for other non-energetic material mixing. The process and apparatus can be utilized to mix any materials that can be supplied in a rolled web form. The apparatus and process can provide continuous mixing of various materials at different proportions with the ability to dynamically control the proportion ratio. The process can be configured to be a relatively low mechanical pressure method (except for the area between rollers) that uses rollers to compress multiple layers of materials to perform the mixing, hence avoiding high internal tube and machine pressures, i.e. hundreds of PSI, that can lead to burst hazards in other methods and processes.

It is noted that terms like "specifically," generally, "preferably," "commonly," and "typically" are not utilized herein to limit the scope of the claimed disclosure or to imply that certain features are critical, essential, or even important to the structure or function of the claimed disclosure. Rather, these terms are merely intended to highlight alternative or additional features that may or may not be utilized in a particular embodiment of the present disclosure. It is also noted that terms like "substantially" and "about" are utilized herein to represent the inherent degree of uncertainty that may be attributed to any quantitative comparison, value, measurement, or other representation.

Having described the disclosure in detail and by reference to specific embodiments thereof, it will be apparent that modifications and variations are possible without departing from the scope of the disclosure defined in the appended claims. More specifically, although some aspects of the present disclosure are identified herein as preferred or particularly advantageous, it is contemplated that the present disclosure is not necessarily limited to these preferred aspects of the disclosure.

All documents cited in the Detailed Description of the Disclosure are, in relevant part, incorporated herein by reference; the citation of any document is not to be construed as an admission that it is prior art with respect to the present disclosure. To the extent that any meaning or definition of a term in this written document conflicts with any meaning or definition of the term in a document incorporated by reference, the meaning or definition assigned to the term in this written document shall govern.

While particular embodiments of the present disclosure have been illustrated and described, it would be obvious to those skilled in the art that various other changes and modifications can be made without departing from the spirit and scope of the disclosure. It is therefore intended to cover in the appended claims all such changes and modifications that are within the scope of this disclosure.

What is claimed is:

1. A method for producing a compressed composite material, comprising, providing a first compressible material;

providing an energetic material;

combining the first compressible material and the energetic material into a composite material;

supplying the composite material to a pair of primary compression rollers;

compressing the composite material through the pair of primary compression rollers into a web;

combining and compressing the web through a pair of secondary compression rollers;

providing an extruder; and extruding the web through the extruder as a mixed, compressed composite energetic material.

2. The method for producing a compressed composite energetic material of claim 1, wherein the energetic material is in a granular form.

3. The method for producing a compressed composite energetic material of claim 1, wherein the energetic material is cyclonite.

4. The method for producing a compressed composite energetic material of claim 1, wherein the energetic material is hexogen.

5. The method for producing a compressed composite energetic material of claim 1, wherein the energetic material comprises cyclotetramethylenetetranitramine.

6. The method for producing a compressed composite energetic material of claim 1, wherein the energetic material comprises trinitrotoluene.

7. The method for producing a compressed composite energetic material of claim 1, further comprising providing a second compressible material, combining the first and second compressible materials, and wherein the energetic material is combined with one of the first compressible material and the second compressible material.

8. The method for producing a compressed composite energetic material of claim 1, wherein the pair of primary compression rollers comprise two metal rollers having parallel rotational axes.

9. The method for producing a compressed composite energetic material of claim 1, wherein the pair of secondary compression rollers comprise two metal rollers having parallel rotational axes.

10. A method for producing a compressed composite material, comprising, providing a first compressible material;

providing an energetic material;

combining the first compressible material and the energetic material into a composite material;

supplying the composite material to a plurality of pairs of primary compression rollers;

compressing the composite material through the plurality of pairs of primary compression rollers into a plurality of webs;

combining and compressing the plurality of webs through a pair of secondary compression rollers into a single web;

providing an extruder; and extruding the single web through the extruder as a mixed, compressed composite energetic material.

11. The method for producing a compressed composite energetic material of claim 10, wherein the energetic material is in a granular form.

12. The method for producing a compressed composite energetic material of claim 10, wherein the energetic material is cyclonite.

13. The method for producing a compressed composite energetic material of claim 10, wherein the energetic material is hexogen.

14. The method for producing a compressed composite energetic material of claim 10, wherein the energetic material comprises cyclotetramethylenetetranitramine.

15. The method for producing a compressed composite energetic material of claim 10, wherein the energetic material comprises trinitrotoluene.

16. The method for producing a compressed composite energetic material of claim 10, further comprising providing a second compressible material, combining the first and second compressible materials, and wherein the energetic material is combined with one of the first compressible material and the second compressible material.

17. The method for producing a compressed composite energetic material of claim 10, wherein the plurality of pairs of primary compression rollers comprise two metal rollers having parallel rotational axes.

18. The method for producing a compressed composite energetic material of claim 10, wherein the plurality of pairs of secondary compression rollers comprise two metal rollers having parallel rotational axes.

19. The method for producing a compressed composite energetic material of claim 10, wherein the extruder is a screw extruder.

20. The method for producing a compressed composite energetic material of claim 10, further comprising guide members.

* * * * *